US009933726B2

(12) United States Patent
Isobe et al.

(10) Patent No.: US 9,933,726 B2
(45) Date of Patent: Apr. 3, 2018

(54) DEVELOPER CONTAINER, CARTRIDGE AND IMAGE FORMING APPARATUS

(71) Applicant: CANON KABUSHIKI KAISHA, Tokyo (JP)

(72) Inventors: Yuta Isobe, Kawasaki (JP); Kazuhisa Shida, Kawasaki (JP); Takayuki Kanazawa, Yokohama (JP); Shunsuke Mizukoshi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/456,992

(22) Filed: Mar. 13, 2017

(65) Prior Publication Data

US 2017/0261886 A1 Sep. 14, 2017

(30) Foreign Application Priority Data

Mar. 14, 2016 (JP) ..... 2016-049193

(51) Int. Cl.
*G03G 15/08* (2006.01)

(52) U.S. Cl.
CPC ..... *G03G 15/0881* (2013.01)

(58) Field of Classification Search
CPC ..... G03G 15/0881
See application file for complete search history.

(56) References Cited

U.S. PATENT DOCUMENTS 9,164,430 B2 * 10/2015 Murakami ..... G03G 15/0882
9,188,906 B2 11/2015 Batori et al.
9,285,707 B2 * 3/2016 Matsushita ..... G03G 15/0874
2001/0033756 A1 * 10/2001 Shiratori ..... G03G 21/1857 399/103
2013/0136489 A1 * 5/2013 Yamaguchi ..... G03G 15/0881 399/106
2013/0164039 A1 * 6/2013 Matsushita ..... G03G 21/18 399/258
2013/0164040 A1 * 6/2013 Matsushita ..... G03G 15/0874 399/258

(Continued)

FOREIGN PATENT DOCUMENTS

JP H05197288 A 8/1993
JP 4665583 B2 4/2011

(Continued)

*Primary Examiner* — G. M. Hyder

(74) *Attorney, Agent, or Firm* — Rossi, Kimms & McDowell LLP

(57) ABSTRACT

A developer container includes a container, provided with an opening and configured to accommodate a developer; a sealing member configured to cover the opening; and an unsealing member configured to unseal the opening by moving the sealing member. The sealing member opposes the container at a central opposing portion positioned in a central side and at an end opposing portion positioned at an end side with respect to a longitudinal direction of the unsealing member. The sealing member and the container are bonded to each other at bonding portion which is at least a part of the central opposing portion. The bonding force at the bonding portion of the central opposing portion is larger than a bonding force between the sealing member and the container at the end opposing portion.

23 Claims, 7 Drawing Sheets

(56) References Cited

U.S. PATENT DOCUMENTS

2013/0308972 A1* 11/2013 Shindo ..... G03G 15/0882 399/106
2013/0336679 A1* 12/2013 Furutani ..... G03G 15/0874 399/258
2013/0343785 A1* 12/2013 Matsuzaki ..... G03G 15/0874 399/258
2014/0016961 A1* 1/2014 Yasui ..... G03G 15/08 399/106
2014/0029974 A1* 1/2014 Uesugi ..... G03G 15/0874 399/106
2014/0064793 A1* 3/2014 Matsuzaki ..... G03G 15/0841 399/258
2014/0072329 A1* 3/2014 Uesugi ..... G03G 15/0874 399/106
2014/0072330 A1* 3/2014 Yoshida ..... G03G 15/0884 399/106
2014/0072331 A1* 3/2014 Matsushita ..... G03G 15/0884 399/106
2014/0072345 A1* 3/2014 Matsunaga ..... G03G 15/0874 399/258
2014/0072346 A1* 3/2014 Furutani ..... G03G 15/0865 399/262
2014/0072347 A1* 3/2014 Furutani ..... G03G 15/0874 399/262
2014/0079432 A1* 3/2014 Matsuzaki ..... G03G 15/0874 399/106
2014/0086620 A1* 3/2014 Takeuchi ..... G03G 15/0882 399/106
2014/0086621 A1* 3/2014 Makiguchi ..... G03G 15/0877 399/106
2014/0093272 A1* 4/2014 Matsumaru ..... G03G 15/0881 399/106
2014/0126928 A1* 5/2014 Batori ..... G03G 21/1832 399/106
2014/0199096 A1* 7/2014 Yoshida ..... G03G 21/1676 399/258
2014/0212166 A1* 7/2014 Takeuchi ..... G03G 15/0898 399/106
2014/0212181 A1* 7/2014 Nakamura ..... G03G 15/0874 399/258
2014/0356020 A1* 12/2014 Murakami ..... G03G 15/0882 399/106
2014/0376955 A1* 12/2014 Takeuchi ..... G03G 15/0881 399/106
2014/0376969 A1* 12/2014 Batori ..... G03G 15/0874 399/258
2015/0003865 A1* 1/2015 Batori ..... G03G 15/0882 399/106
2017/0168422 A1* 6/2017 Takeuchi ..... G03G 15/0881
2017/0212452 A1* 7/2017 Matsuzaki ..... G03G 15/0898
2017/0235251 A1* 8/2017 Matsuzaki ..... G03G 15/0889 399/111
2017/0261886 A1* 9/2017 Isobe ..... G03G 15/0881

FOREIGN PATENT DOCUMENTS

JP 2014112206 A 6/2014
JP 2015004954 A 1/2015

* cited by examiner

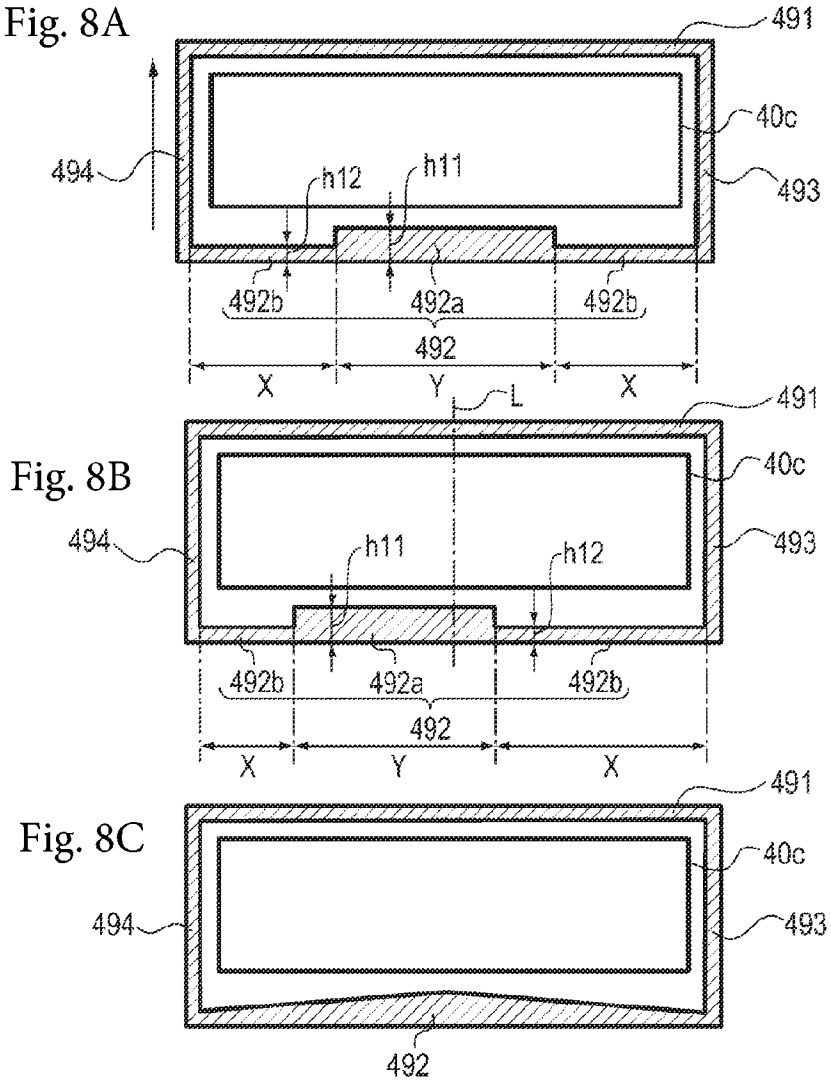
Fig. 8A
Fig. 8B
Fig. 8C
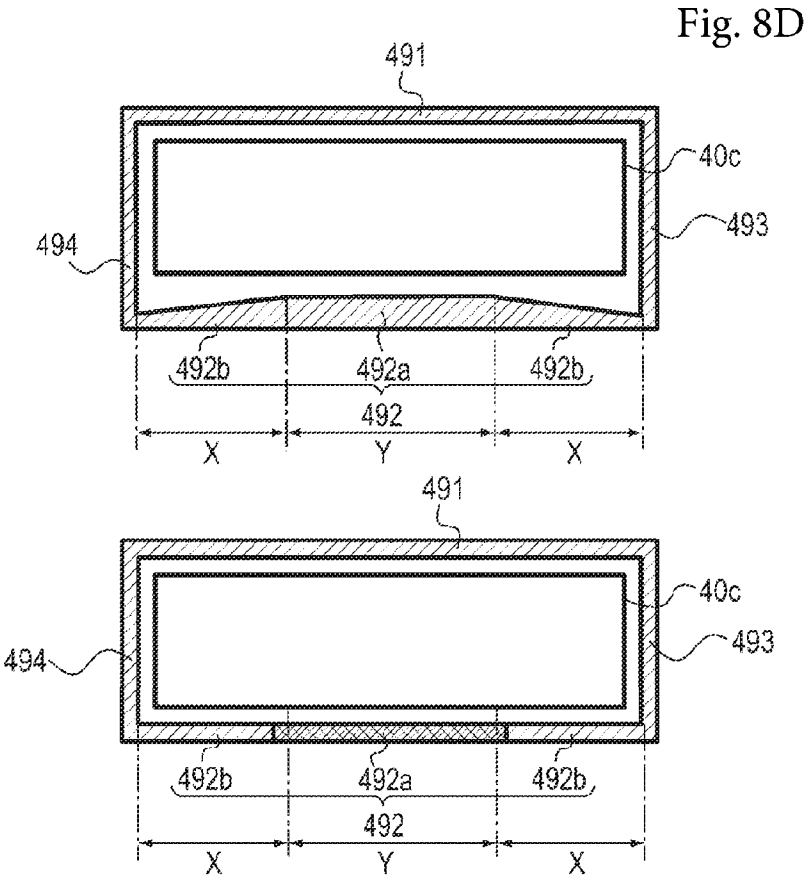
Fig. 8D
Fig. 8E

DEVELOPER CONTAINER, CARTRIDGE AND IMAGE FORMING APPARATUS

FIELD OF THE INVENTION AND RELATED ART

The present invention relates to a developer container accommodating a developer, a cartridge including the developer container and an image forming apparatus including the developer container.

Conventionally, in an image forming apparatus of an electrophotographic type, a photosensitive drum electrically charged uniformly by a charging means is subjected to selective exposure to light depending on image information, so that a latent image is formed on the drum. Then, the latent image is developed with toner by a developing means, so that a toner image is formed on the drum. Thereafter, the toner image formed on the drum is transferred onto a recording material by a transfer means, so that image formation is carried out.

Here, as disclosed in Japanese Laid-Open Patent Application Hei 5-197288, a constitution in which a toner supply opening for establishing communication between a toner chamber and a developing chamber is sealed using a developing container partitioning member and the developing container partitioning member is removed (unsealed) by a rotatable member has been proposed. This unsealing is carried out by automatic winding-up, about the rotatable member, of the developing container partitioning member mounted to the rotatable member in the toner chamber at one end thereof. After the unsealing, the developing container partitioning member rotates together with the rotatable member as a unit. As a result, it is possible to prevent the toner from leaking out through the opening during an unused state of the developer container. Further, the developing container partitioning member remains in the developer container, and therefore there is no need for a user to dispose of the developing container partitioning member. Further, the user is not required to unseal the developing container partitioning member, and therefore usability is improved.

Further, as disclosed in Japanese patent Publication No. 4665583, in order to minimize a load during the unsealing, a constitution in which a part of the developing container partitioning member is bonded to a developer container has been proposed.

However, in the case where an accommodation amount (weight) of the toner is increased, also toner pressure exerted on the developing container partitioning member during transportation increases. In this case, the developing container partitioning member is unsealed by the increased toner pressure, so that the toner leaks out through an opening.

SUMMARY OF THE INVENTION

A principal object of the present invention is to suppress a load during unsealing to a minimum level while preventing a developing container partitioning member during an unused state of a developer container.

According to an aspect of the present invention, there is provided a developer container comprising: a container provided with an opening and configured to accommodate a developer; a sealing member configured to cover the opening; and an unsealing member configured to unseal the opening by moving the sealing member, wherein the sealing member opposes the container at a central opposing portion positioned in a central side and at an end opposing portion positioned at an end side with respect to a longitudinal direction of the unsealing member, wherein the sealing member and the container are bonded to each other at bonding portion which is at least a part of the central opposing portion, and wherein a bonding force at the bonding portion of the central opposing portion is larger than a bonding force between the sealing member and the container at the end opposing portion.

Further features of the present invention will become apparent from the following description of exemplary embodiments with reference to the attached drawings.

BRIEF DESCRIPTION OF THE DRAWINGS

FIGS. 8A, 8B, 8C, 8D, and 8E are schematic views each showing a bonded state of a developing container partitioning member in Embodiment 2.

DESCRIPTION OF EMBODIMENTS

Embodiments of the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. That is, the scope of the present invention is not intended to be limited to the following embodiments.

Embodiment 1

Figure 2:
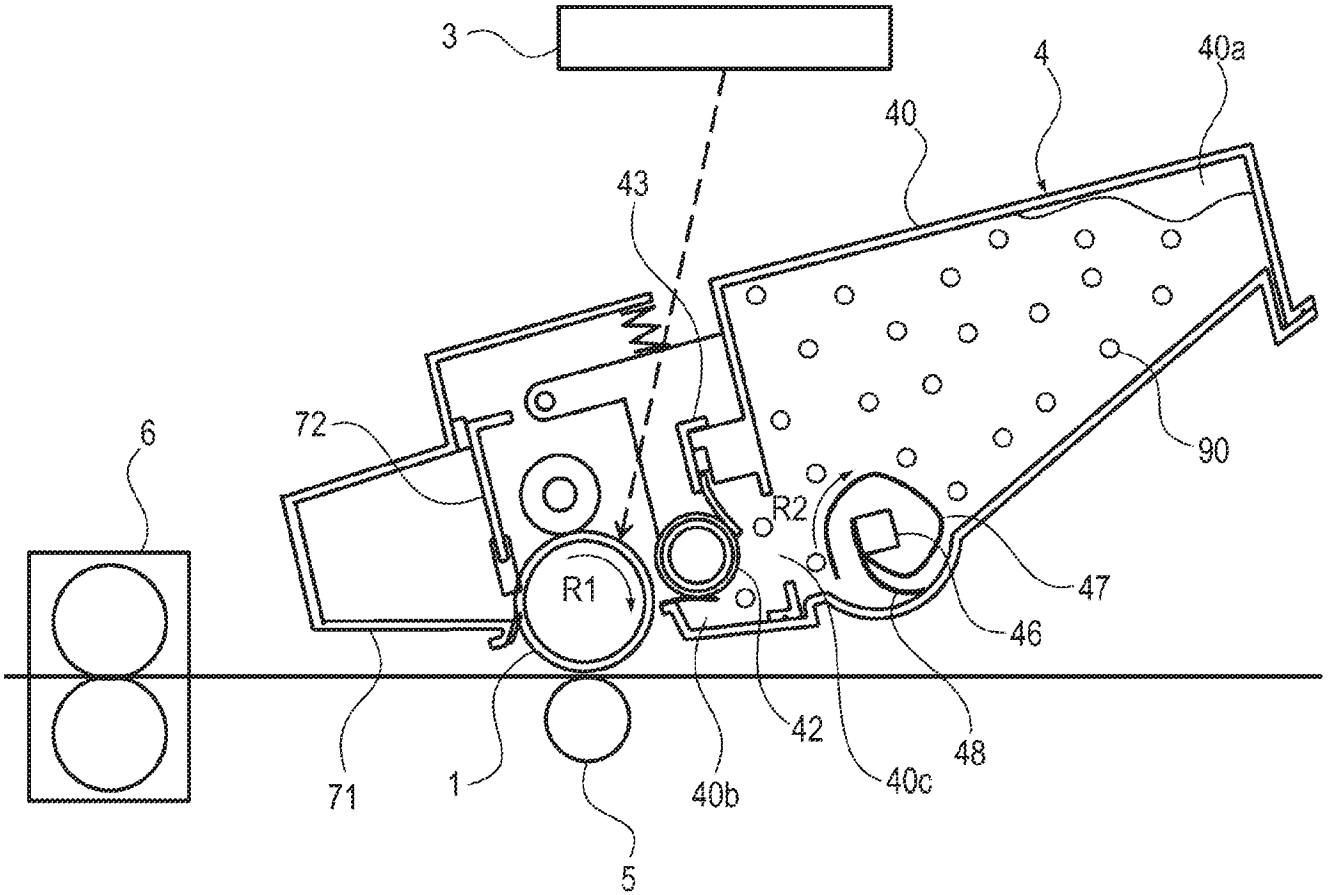
FIG. 2 is a schematic view of an image forming apparatus according to Embodiment 1.

An image forming apparatus including a developing device in this embodiment will be described with reference to FIG. 2. FIG. 2 is a schematic view showing an example of the image forming apparatus. In FIG. 2, a cylindrical photosensitive drum 1 which is an image bearing member rotates in an arrow R1 direction about an axis thereof. A surface of the photosensitive drum 1 is electrically charged uniformly by a charging device 2, and thereafter a latent image is formed on the photosensitive drum 1 by an exposure device 3. A developing device 4 includes a developing container 40 for accommodating and storing toner 90 and a developing sleeve 42 which is a developer carrying member, and supplies the toner, which is a developer, to the latent image formed on the photosensitive drum 1, so that the latent image is visualized. In the neighborhood of the developing sleeve 42, a developing blade 43 which is a developer regulating member is provided. In this embodiment, as the developer carrying member, the developing sleeve 42 is used, but the developer carrying member is not limited thereto. For example, the developer carrying member may also be a developing roller.

The thus-visualized image on the photosensitive drum 1 with the toner 90 is transferred onto a recording material P by a transfer device 5. The recording material P is fed by a sheet feeding roller (not shown) and is synchronized with the toner image on the photosensitive drum 1 by a registration roller pair (not shown), and then is fed to the transfer device 5. The toner image formed with the toner 90 and transferred on the recording material P is fed to a fixing device 6 together with the recording material P, and is fixed on the recording material P by heat or pressure, so that a recording image is formed. On the other hand, a cleaning device 7 includes a cleaning blade 72 and a collected toner accommodating chamber 71, and the toner 90 remaining on the photosensitive drum 1 without being transferred after the transfer is collected by the cleaning blade 72 and is accommodated in the collected toner accommodating chamber 71. Thereafter, the surface of the photosensitive drum 1 is charged again by the charging device 2 and is repetitively subjected to the above-described steps.

The photosensitive drum 1 and, as process means actable on the photosensitive drum 1, the charging device 2, the developing device 4 and the cleaning device 7 are integrally provided as a process cartridge 8 detachably mountable to an image forming apparatus main assembly.

Further, a constitution of the developing device 4 in the image forming apparatus will be described. The developing device 4 includes the developing container 40 which accommodates the toner as the developer and which constitutes a frame provided with a toner supply opening 40*c*. The developing container 40 includes a toner chamber 40*a* as a first developer accommodating chamber and a developing chamber 40*b* as a second developer accommodating chamber. The toner supply opening (hereinafter simply referred to as the opening) 40*c* establishes communication between the toner chamber 40*a* and the developing chamber 40*b*.

The developing device 4 further includes a feeding sheet 48 as a toner feeding member, a developing container partitioning member (sealing member) 47, a rotatable member 46 functioning as an unsealing member and a drive transmitting member (not shown) for transmitting drive (driving force) to the rotatable member 46. The feeding sheet 48 feeds the toner, accommodated in the toner chamber 40*a*, to the developing chamber 40*b* through the opening 40*c*. The feeding sheet 48 is formed of a flexible material such as PET, PC or PPS. The developing device 4 includes a developer container. Of members of the developing device 4, those which excludes the developer carrying member and which includes at least the developing container 40, the developing container partitioning member 47 and the rotatable member 46 constitute the developer container.

The developing container partitioning member 47 covers the opening 40*c* during an unused state of the developer container and accommodates the toner chamber 40*a* and the developing chamber 40*b* of the developing container 40 accommodating the toner. The developing container partitioning member (toner seal member) 47 is constituted by a material having compatibility with a material of the developing container 40 or by a material including an adhesive layer.

Figure 5:
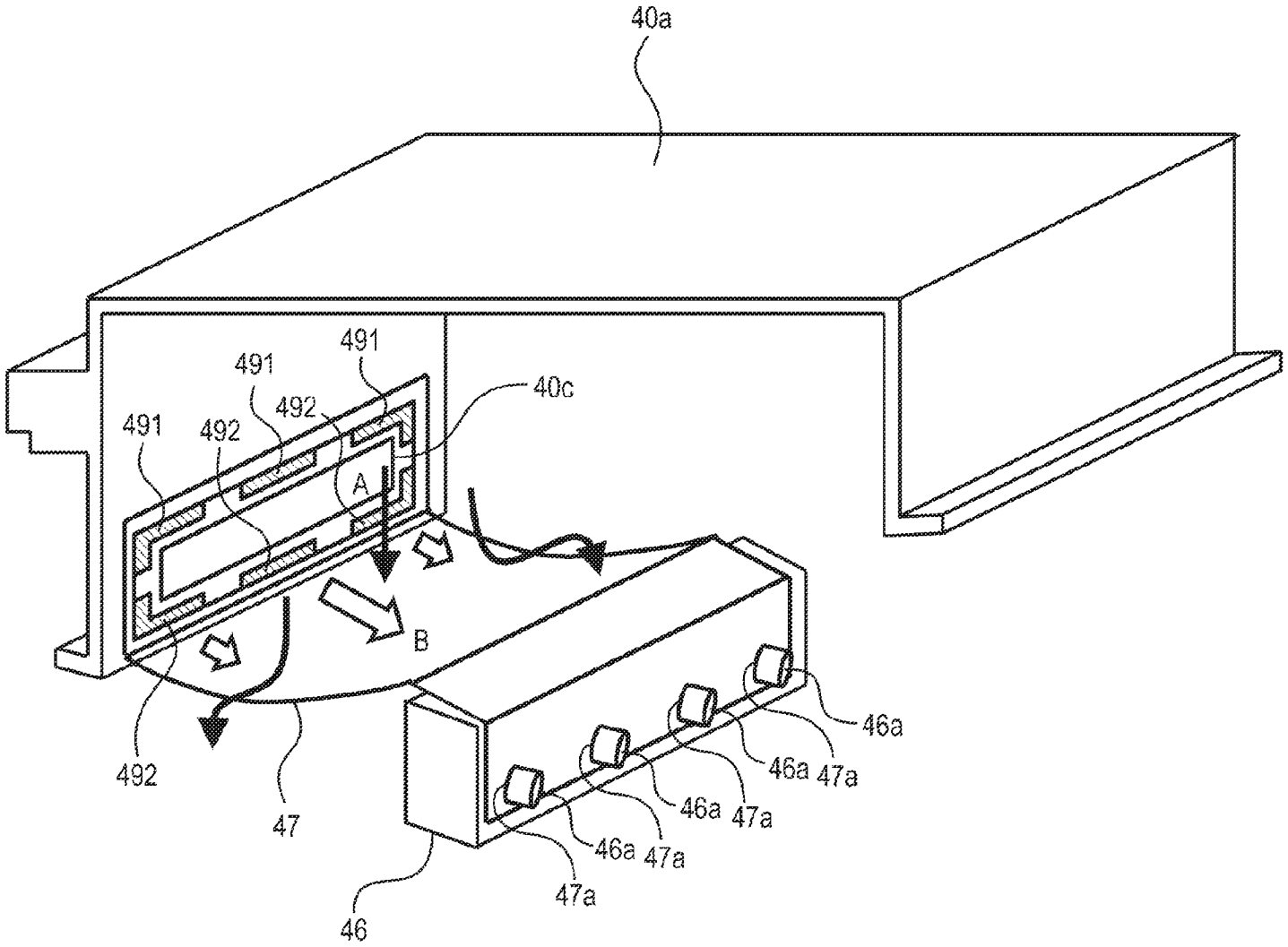
FIG. 5 is a schematic view of a cartridge during transportation.

At one end portion of the developing container partitioning member 47, a plurality of holes 47*a* as shown in FIG. 5. Similarly, also at one end portion of the feeding sheet 48, a plurality of holes (not shown) are provided. The rotatable member 46 is provided with a plurality of projections 46*a* corresponding to the plurality of holes 47*a* of the developing container partitioning member 47 and the plurality of holes of the feeding sheet 48. The holes 47*a* of the developing container partitioning member 47 and the holes of the feeding sheet 48 are engaged with the projections 46*a* of the rotatable member 46 in the named order. Thereafter, the projections 46*a* of the rotatable member 46 is subjected to thermal caulking, so that the developing container partitioning member 47, the feeding sheet 47 and the rotatable member 46 are integrally provided as a unit. An integration method of the developing container partitioning member 47, the feeding sheet 48 and the rotatable member 46 may include, in addition to the thermal caulking, other methods such as welding, snap fitting and double-side tape bonding, and is not limited thereto.

The developing container partitioning member 47 requires a length such that the developing container partitioning member 47 covers the opening 40*c* and is mountable to the rotatable member 46. Here, in order to prevent a free end of the developing container partitioning member 47 from reaching a free end of the feeding sheet 48 after the developing container partitioning member 47 is peeled off from the opening 40*c*, mounting phases of the developing container partitioning member 47 and the feeding sheet 48 to the rotatable member 46 are made equal to each other. Further, with respect to a rotational axis direction (longitudinal direction) of the rotatable member 46, the length of the developing container partitioning member 47 is made shorter than a distance between opposing inner wall surfaces of the developing container 40 in both sides with respect to the longitudinal direction. In this embodiment, with respect to the longitudinal direction of the rotatable member 46, a clearance of 5 mm is provided between one end of the developing container partitioning member 47 and the associated inner wall surface of the developing container 40.

Next, bonding between the developing container partitioning member 47 and the developing container 40 will be described with reference to FIGS. 1 and 3. In FIG. 3, the developing container partitioning member 47 covers the opening 40*c* establishing communication between the toner chamber 40*a* and the developing chamber 40*b*, and is disposed so as to partition the developing container 40 into the toner chamber 40*a* and the developing chamber 40*b*. Bonding between the developing container 40 and the developing container partitioning member 47 is made by pressing a welding horn (not shown), heated to a certain temperature, against the developing container partitioning member 47 and then by thermally welding the developing container partitioning member 47 and the developing container 40. Incidentally, the bonding method of the developing container partitioning member 47 and the developing container 40 is the thermal welding in this embodiment, but is not limited thereto. The bonding method may use a double-side tape, an adhesive or the like. This portion thermally welded is a welded portion 49. The welded portion 49 is a bonding portion, of opposing portions of the developing container partitioning member 47 to the developing container 40, where the developing container partitioning member 47 is bonded (thermally welded) to the developing container 40. In FIG. 1, hatched portions (enclosed by rectangles) are welded portions 49 (491, 492*a*, 492*b*, 493, 494). Incidentally, although described specifically later, the developing container partitioning member 47 may only be required that at least a part of the opposing portion of the developing container partitioning member 47 to the developing container 40 is bonded (thermally welded and thus may include a non-bonding portion which is not bonded to the developing container 40. In FIG. 1, of the welded portion 492, a portion which is not bonded (thermally welded) to the developing container 40 between adjacent welded portions is the non-bonding portion. Specifically, portions between the welded portions 492*a* and 492*b*, between the welded portions 492*b* and 492*b*, between the welded portions 492*a* and 493 and between the welded portions 492*a* and 494 are non-bonding portions 492*c*. In addition, in FIG. 1, although no reference numeral is added, also portions between the welded portions 491 and 491, between the welded portions 493 and 493 and between the welded portions 494 and 494 are the non-bonding portions.

As shown in FIGS. 1 and 3, of the welded portions 49 of the developing container partitioning member 47, the welded portions close to the free end of the developing container partitioning member 47 are first welded portions 491. Further, the welded portions closer to the rotatable member 46 than the first welded portions 491 are via the opening 40*c* are second welded portions 492. The first welded portions 491 and the second welded portions 492 are provided at least at a part of the opposing portion to the developing container 40 with respect to the longitudinal direction of the opening 40*c*. Of the opposing portion of the developing container partitioning member 47 to the developing container 40, the welded portions at one longitudinal end portion of the opening 40*c* are third welded portions 493, and the welded portions at the other longitudinal end portion of the opening 40*c* are fourth welded portions 494. The third welded portions 493 are welded portions close to a drive inputting position of the rotatable member 46 with respect to a widthwise direction (direction crossing the longitudinal direction) of the opening 40*c*. On the other hand, the fourth welded portions 494 are welded portions remote from the drive inputting position of the rotatable member 46 with respect to the widthwise direction. Incidentally, a drive transmitting member (not shown) for transmitting drive (driving force) to the rotatable member 46 is provided in a one end portion side which is a drive inputting position side with respect to the longitudinal direction.

Figure 3A:
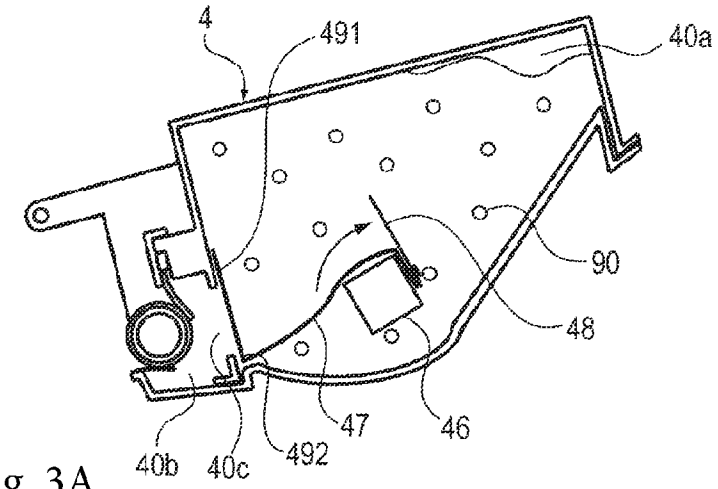
FIGS. 3A, 3B, 3C, and 3D are schematic views for illustrating an unsealing operation of the developing container partitioning member in Embodiment 1.
Figure 3B:
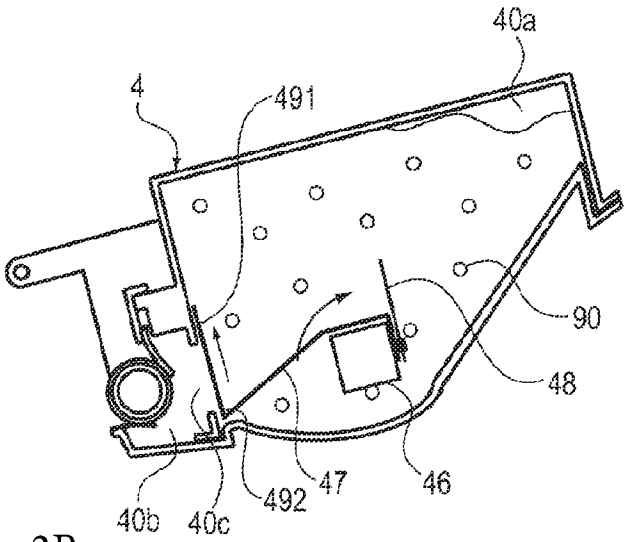
Figure 3C:
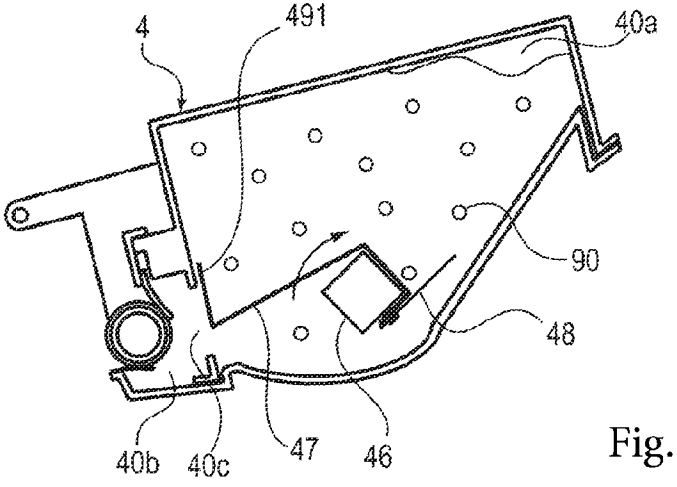
Figure 3D:
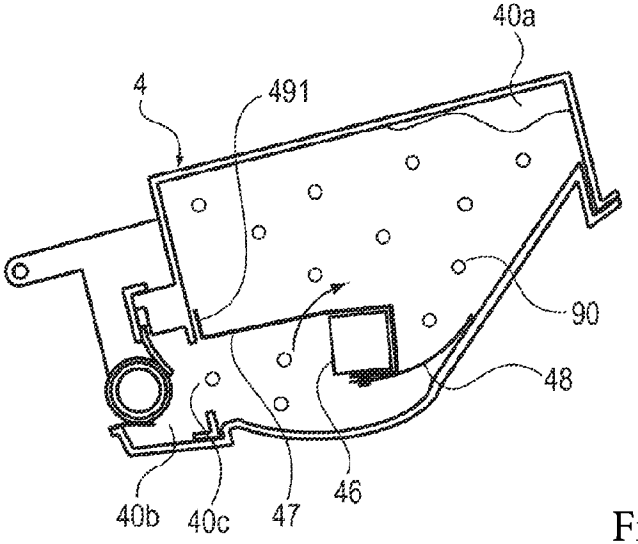

Next, an unsealing operation of the developing container partitioning member 47 performed during a start of use of the developing device 4 will be described with reference to FIG. 3. When the process cartridge is mounted in the image forming apparatus main assembly and receives the drive (driving force) from the apparatus main assembly, the rotatable member 46 rotates in an arrow direction as shown in FIG. 3A. When the rotatable member 46 rotates, as shown in FIG. 3B, the developing container partitioning member 47 is to be wound up by the rotatable member 46. Here, of the welded portions 49 of the developing container partitioning member 47 bonded to the developing container 40, the second welded portions 492 in an upstream side with respect to a movement direction of the developing container partitioning member 47 by rotation of the rotatable member 46 is peeled off first. Subsequently, as shown in FIG. 3A, the third welded portions 493 and the fourth welded portions 494 are peeled off. Then, as shown in FIG. 3D, via the opening 40*c*, the first welded portions 491 in a downstream side with respect to the movement direction are peeled off finely. As a result, at the opposing portion of the developing container partitioning member 47 to the developing container 40, all of the welded portions welded to the developing container 40 are peeled off from the developing container 40, so that the opening 40*c* is unsealed (exposed). Then, through the opening 40*c* unsealed by the rotatable member 46, the toner is supplied from the toner chamber 40*a* to the developing chamber 40*b* by the rotating feeding sheet 48. Incidentally, the movement direction of the developing container partitioning member 47 by the rotation of the rotatable member 46 is an arrow direction shown in FIG. 1 and is a direction crossing the longitudinal direction of the rotatable member 46.

Figure 6:
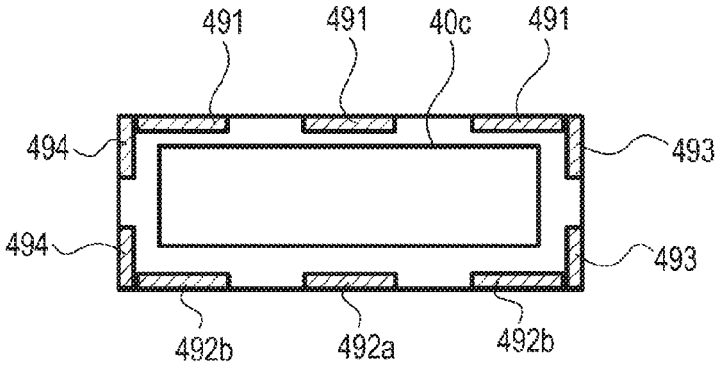
FIG. 6 is a schematic view of a bonded state of a developing container partitioning member in a comparison example.

Then, welded portions 49 in a comparison example will be specifically described with reference to FIG. 6. In a constitution of the comparison example, an opening 40*c* is 20 mm in width with respect to a height direction (widthwise direction) and is 240 mm in length in which the opening 40*c* extends in the longitudinal direction. A developing container partitioning member 47 is disposed at a position where the developing container partitioning member 47 covers the opening 47*c* and is 250 mm in length with respect to the longitudinal direction. In the constitution of the comparison example, as shown in FIG. 6, as first welded portions 491, three welded portions 491 are equidistantly disposed in the longitudinal direction. Each of the welded portions 491 is 1 mm in welding width (length with respect to the welded portion of the opening) and 50 mm in length (with respect to the longitudinal direction of the opening). Further, a length (with respect to the longitudinal direction of the opening) of a portion, between the adjacent welded portions, where the developing container partitioning member 47 is not welded to the developing container 40 is 48 mm. Also the second welded portions 492 are in a welded state similar to that of the first welded portions 491. Further, as the third welded portions 493, two welded portions 492 are disposed in the widthwise direction. Each of the welded portions is 1 mm in welding width (length with respect to the longitudinal direction of the opening) and 5 mm in height with respect to the widthwise direction of the opening). A height (length with respect to the widthwise direction of the opening) of a portion, between the adjacent welded portions, where the developing container partitioning member 47 is not welded to the developing container 40 is 18 mm. Also the four welded portions 494 are in a welded state similar to that of the third welded portions 493. At the portion, between the adjacent welded portions, where the developing container partitioning member 47 is not welded to the developing container 40, the developing container partitioning member 47 is maintained in a state of no flexure, so that the developing container partitioning member 47 and the developing container 40 are in a contact state. This state is a state in which the toner 90 does not so leak out. In the constitution, a welding temperature at the first to fourth welded portions is 140° C.

Figure 4A:
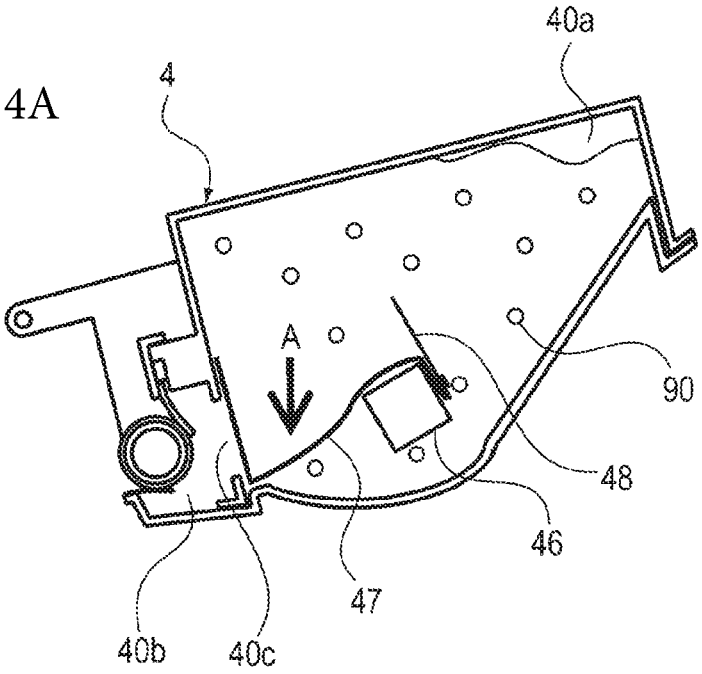
FIGS. 4A and 4B are schematic view each showing the developing container partitioning member during transportation in Embodiment 1.
Figure 4B:
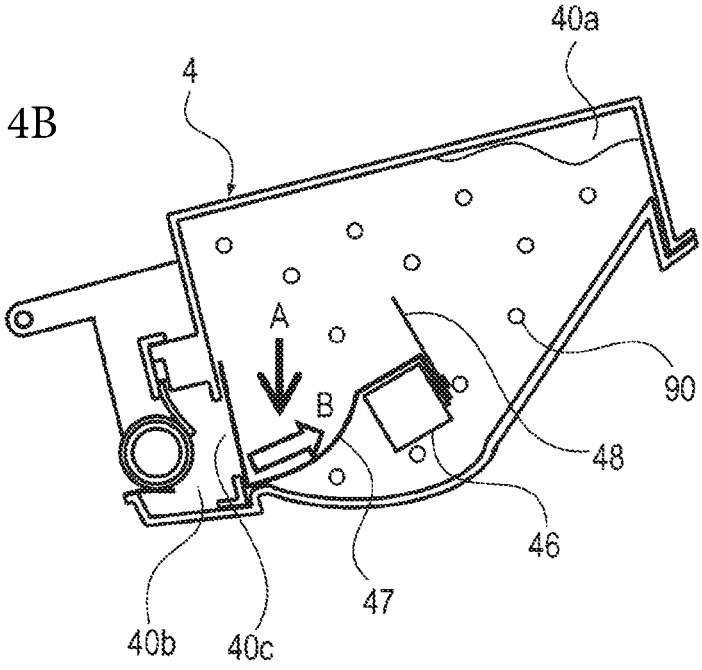

Next, a state of the process cartridge during transportation (during an unused state) will be described with reference to FIG. 4. As shown in (a) of FIG. 4, during transportation, in an attitude that a weight of the toner 90 accommodated in the toner chamber 40*a* is exerted on the developing container partitioning member 47, the process cartridge is dropped in an arrow A direction. Then, pressure of the toner 90 is applied to the developing container partitioning member 47 in the arrow A direction. By the pressure of the toner 90, a peeling force in a hollow arrow B is applied to the developing container partitioning member 47 as shown in (b) of FIG. 5. Then, motion of the toner 90 during drop is shown in FIG. 5. The developing container partitioning member 47 is provided with a pressure clearance (5 mm in this case) from an inner wall of the developing container 40. For that reason, at a longitudinal end portion of the opening 40*c*, as shown in FIG. 5, the toner 90 flows toward the longitudinal end portion of the opening 40*c*. As a result, an amount of the toner 90 exerted on the developing container partitioning member 47 decreases, and therefore the pressure of the toner 90 becomes small. On the other hand, at a longitudinal central portion, the pressure of the toner 90 is all applied to the developing container partitioning member 47, and therefore a large pressure is applied to the developing container partitioning member 47. As a result, to the welded portions (central welded portion 492*a*) of the second welded portions 492 particular in a longitudinal central portion side, a large force is applied in the peeling-off direction (the hollow arrow B direction). In the case where the peeling-off force is larger than a bonding force (binding force) between the developing container partitioning member 47 and the developing container 40, the developing container partitioning member 47 is peeled off from the developing container 40. As a result, the opening 40*c* is unsealed, so that the toner 90 in the toner chamber 40*a* is in a state in which the toner 90 can freely move to the developing chamber 40*b* through the opening 40*c*. Further, when motion such as vibration or drop is repeated, the toner 90 leaks out of the developing device 4, so that the process cartridge is contaminated with the toner 90.

The constitution of this embodiment will be described with reference to FIGS. 1A, 1B, 1C, 1D, and 1E. The second welded portions 492 as a feature of the constitution of this embodiment will be specifically described.

As shown in FIGS. 1A, 1B, 1C, 1D, and 1E, the developing container partitioning member 47 is bonded to the developing container 40 at least at a part of a central(-side) opposing portion, of the opposing portions opposing to the developing container 40, positioned in a central side of the developing container partitioning member 47 with respect to the longitudinal direction. The bonding portion bonded to the developing container at the central opposing portion is the central portion 492*a* of the second welded portions 492. The second welded portions 492 shown in FIG. 5 are bonded to the developing container 40 at least at a part of an end (portion-side) opposing portion positioned in an end portion side with respect to the longitudinal direction. The bonding portion bonded to the developing container 40 at the end opposing portion is the end portions 492*b* of the second welded portions 492. The central portion 492*a* of the second welded portions 492 is provided so that a bonding force thereof to the developing container 40 is larger than that of the end portions 492*b*. This will be specifically described.

As described above, the portion where the toner pressure is largely applied to the developing container partitioning member 47 during the transportation (during the unused state) is the central portion with respect to the longitudinal direction of the opening 40*c*. Therefore, in the constitution shown in FIG. 1A, the central portion 492*a* which is the bonding portion bonded to the developing container 40 at the central opposing portion is provided so that a welding width h11 with respect to a movement direction of the developing container partitioning member 47 by the rotatable member 46 is larger than a welding width h12 at each of the end portions 492*b* (h11>h12). Specifically, in the constitution shown in FIG. 1A, the welding width h11 of the central portion 492*a* of the second welded portion 492 is 3 mm, and the welding width h12 of each of the end portions 492*b* is 1 mm. Here, each of the welding widths h11 and h12 is a width (length) with respect to the widthwise direction crossing the longitudinal direction of the opening 40*c* and is a width with respect to the movement direction (arrow direction in FIG. 1A) of the developing container partitioning member 47 by the rotatable member 46. By employing the constitution described above, the bonding force of the central portion 492*a* positioned in a central side of the second welded portion 492 with respect to the longitudinal direction is larger than the bonding force of the end portions 492*b*, so that the central portion 492*a* is prevented from being peeled off from the developing container 40 during the transportation. In addition, a load when the developing container partitioning member 47 is unsealed can be minimized.

Incidentally, in FIG. 1, each of regions X is an end opposing portion positioned in a longitudinal end portion side, and a region Y is a central opposing portion positioned in a longitudinal central portion side. In the respective X and Y regions, bonding portions bonded to the developing container 40 are the end portions 492*b* and the central portion 492*a*. Further, non-bonding portions which are not bonded to the developing container 40 at the respective regions X and Y are the non-bonding portions 492*c*.

Figure 1A:
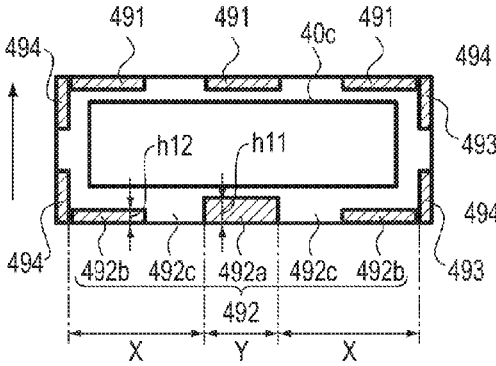
FIGS. 1A, 1B, 1C, 1D, 1E, and 1F are schematic views each showing a bonded state of a developing container partitioning member in Embodiment 1.
Figure 1D:
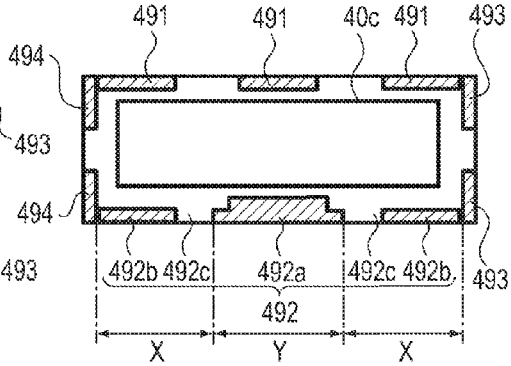
Figure 1B:
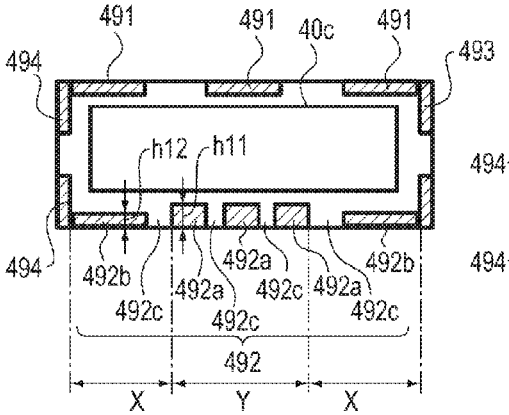

In the constitution shown in FIG. 1B, of the opposing portions opposing the developing container 40, a plurality of central portions 492*a*, of the second welded portion 492, which are bonding portions bonded to the developing container 40 are provided at the central opposing portion so as to sandwich non-bonding portions 492*c* which are not bonded to the developing container 40. Thus, even when the constitution in which the plurality of central portions 492*a* of the second welded portion are provided with intervals (constituted by the non-bonding portions 492*c*), an effect similar to that of the above-described constitution can be obtained.

Figure 1E:
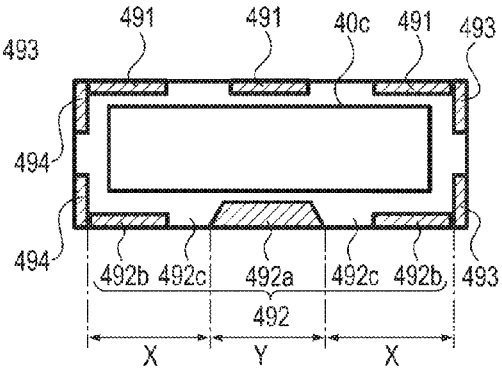
Figure 1C:
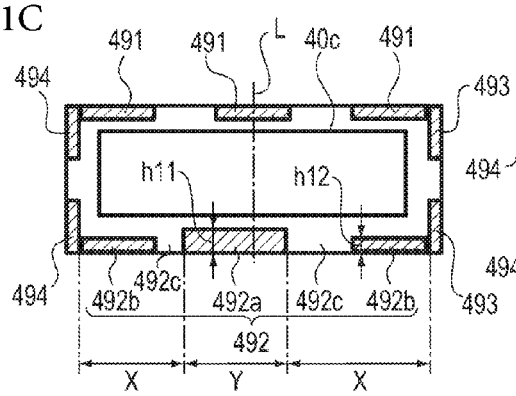

In the constitution shown in FIG. 1C, a central portion 492*a*, of the second welded portion 492, which is a bonding portion bonded to the developing container 40 at the central opposing portion is provided so as to shift toward one end portion side with respect to the longitudinal direction of the rotatable member 46 on the basis of a center line L positioned at the longitudinal center. Even when such a constitution is employed, an effect similar to that of the above-described constitution can be obtained. The central opposing portion refers to an opposing portion at least including the center line L. In this embodiment, when a corresponding portion of the partitioning member corresponding to the center line L has a bonding force to the container larger than a bonding force of a corresponding portion of the partitioning member positioned on a rectilinear line which is parallel to an unsealing direction and which passes through an edge of the opening, an effect is achieved. The latter corresponding portion of the partitioning member may also be not bonded to the container.

In each of the constitutions shown in FIGS. 1D and 1E, a central portion 492*a*, of the second welded portion 492, which is a bonding portion bonded to the developing container 40 at the central opposing portion is provided so that a width thereof with respect to the movement direction of the developing container partitioning member 47 by the rotatable member 46 varies with respect to the movement direction. Specifically, in the constitution shown in FIG. 1D, the width (length with respect to the widthwise direction of the opening 40*c*) of the central portion 492*a* stepwisely increases from a longitudinal end portion side toward a longitudinal central portion side. On the other hand, in the constitution shown in FIG. 1E, the width (length with respect to the widthwise direction of the opening 40*c*) of the central portion 492*a* continuously increases from the longitudinal end portion side toward the longitudinal central portion side. Even when these constitutions are employed, an effect similar to that of the above-described constitution can be obtained.

Figure 1F:
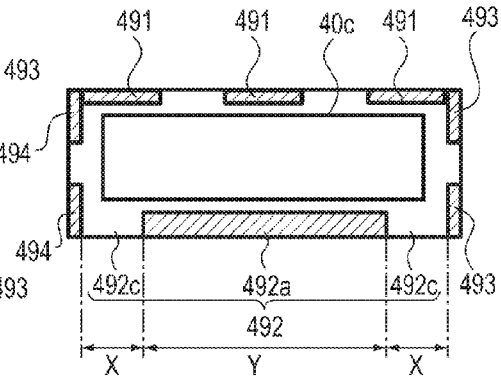

Further, in the constitution shown in FIG. 1F, a longitudinal length of the central portion 492*a* of the second welded portion 492 is made longer than those of other constitutions described above. In addition, in the constitution shown in FIG. 1F, with respect to the longitudinal direction of the opening 40*c*, of opposing portions opposing the developer container 40, the end opposing portions are non-bonding portions 492*c* which are not bonded to the developing container 40. As a result, both of a state in which the longitudinal end portions of the developing container partitioning member 47 are held and a state in which the developing container partitioning member 47 in not peeled off from the developing container 40 by the toner pressure during the transportation are maintained. Incidentally, when the above-described states are both maintained at the central portion and the end portions with respect to the longitudinal direction are maintained, shapes, widths, bonding forces and the like of the bonding portions are not limited to the constitution shown in FIG. 1F.

Figure 7:
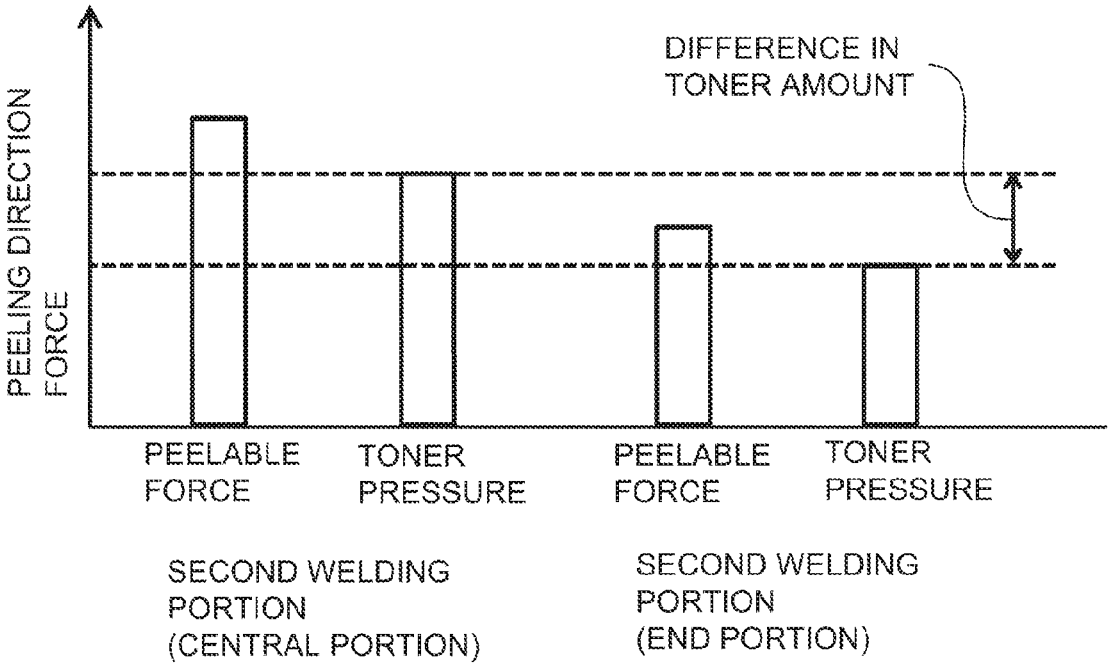
FIG. 7 is a schematic diagram showing a relationship among forces exerted on the developing container partitioning member in Embodiment 1.

Then, a force capable of peeling off the second welded portion 492 and a peeling-off force by the toner pressure during the transportation in the constitution in this embodiment will be described with reference to FIG. 7. As described above, by drop or the like, a large force is exerted on the central portion 492*a* of the second welded portion 492 in the developing container partitioning member 47. In the constitution shown in FIGS. 1A, 1B, 1C, 1D, 1E, and 1F, the central portion 492*a* has the welding width larger than those of the end portions 492*b* (h11>h12), so that the force capable of peeling of the second welded portion 492 is larger at the central portion than at the end portions. As a result, the force capable of peeling off the second welded portion 492 can be kept in a larger state than the peeling-off force by the toner pressure at both of the central opposing portion and the end opposing portions of the developing container partitioning member 47. As a result, the toner can be maintained in the toner chamber 40*a*, so that the process cartridge is prevented from being contaminated with the toner. That is, according to this embodiment, it is possible to prevent the developing container partitioning member 47 from being peeled off from the developing container 40 during the unused state and to suppress the load to a minimum when the developing container partitioning member 47 is unsealed.

Embodiment 2

An image forming apparatus including a developing device in this embodiment will be described. In this embodiment, a bonding constitution between the developing container partitioning member and the developing container is different from Embodiment 1 described above. For that reason, a basic constitution of the image forming apparatus is unchanged, and therefore members having the same (equivalent) functions as those in Embodiment 1 are represented by the same reference numerals or symbols and will be omitted from redundant description. In the following, a feature portion of this embodiment which is a portion different from Embodiment 1 will be described.

In this embodiment, as shown in FIGS. 8A, 8B, 8C, 8D, and 8E, an opposing portion of the developing container partitioning member 47 opposing the developing container 40 is bonded to the developing container 40 over a full circumference of a periphery of the opening 40*c* of the developing container 40. This bonded portion is a welded portion 49. The welded portion 49 as a feature of this embodiment will be described with reference to FIG. 8.

In this embodiment, in order to completely prevent the toner from leaking out from the toner chamber 40*a* into the developing chamber 40*b*, the developing container partitioning member 47 is welded to the developing container 40 along the full circumference of the periphery of the opening 40*c*. As shown in FIG. 8A, a welding width (length with respect to the welded portion of the opening) of a first welded portion 491 is 1 mm, and a longitudinal length of the first welded portion 491 is 246 mm. The longitudinal length of a second welded portion 492 is 246 mm equal to that of the first welded portion 491. Welding widths (length with respect to the welded portion of the opening) of the second welded portion 492 are 1 mm at the end opposing portion (regions X) positioned in longitudinal end portion sides and 3 mm at the central opposing portion (region Y) positioned in a central portion side. That is, a width h11 of a central portion 492*a* bonded to the developing container 40 in the region Y is made broader than widths h12 of end portions 492*b* bonded to the developing container 40 in the regions X. In other words, a bonding force of the central portion 492*a* to the developing container 40 is made larger than a bonding force of the end portions 492*b* to the developing container 40. Incidentally, each of the regions X is a region of 82 mm from an associated end of the second welded portion 492, and the region Y is a region of 82 mm at the central portion of the second welded portion 492. By employing the constitution described above, the bonding force of the central portion 492*a* positioned in a central side of the second welded portion 492 with respect to the longitudinal direction is larger than the bonding force of the end portions 492*b*, so that the central portion 492*a* is prevented from being peeled off from the developing container 40 during the transportation. In addition, a load when the developing container partitioning member 47 is unsealed can be minimized.

Incidentally, the central portion 492*a* having the welding width h11 is influenced by the pressure applied by the toner accommodated in the toner chamber. In this embodiment, the welding width h11 of the central portion 492*a* is made 3 mm wider than the welding width of the end portions 492*b*, but there is a need to further increase the welding width in the case where the length of the developing container partitioning member 47 is long and in the case where specific gravity of the toner accommodated in the toner chamber 40*a* is large. On the other hand, in the case where the length of the developing container partitioning member 47 is short and in the case where the specific gravity of the accommodated toner is small, the welding width may be narrow. Further, in this embodiment, each of lengths of the central portion in the region Y and the end portions in the regions X is 82 mm, but the present invention is not limited thereto. However, when the entire welding width is increased, a load during the unsealing increases. As a result, there is a possibility that a problem such that a large force is exerted on the developing container partitioning member 47 and thus the rotatable member 46 is bent or the developing container partitioning member 47 is broken generates and therefore the developing container partitioning member 47 cannot be unsealed. Further, even when the problem in the developing device is prevented, increases in electric power consumption of the image forming apparatus main assembly and in size of the developing device generate.

In the constitution shown in FIG. 8B, a central portion 492*a*, of the second welded portion 492, which is a bonding portion bonded to the developing container 40 at the central opposing portion is provided so as to shift toward one end portion side with respect to the longitudinal direction of the rotatable member 46 on the basis of a center line L positioned at the longitudinal center. Even when such a constitution is employed, an effect similar to that of the above-described constitution can be obtained.

In each of the constitutions shown in FIGS. 8C and 8D, the second welded portion 492 is bonded to the developing container 40 over the longitudinal direction the rotatable member and is provided so that a bonding force thereof to the container is larger in the central portion side than in the end portion side with respect to the longitudinal direction. Specifically, in the constitution shown in FIG. 8E, the width (length with respect to the widthwise direction of the opening 40*c*) of the second welded portion 492 continuously increases from a longitudinal end portion side toward a longitudinal central portion side. On the other hand, in the constitution shown in FIG. 8D, the width (length with respect to the widthwise direction of the opening 40*c*) of the central portion 492*a* of the second welded portion 492 is broader than those of the end portions 492*b*. In addition, the width (length with respect to the widthwise direction of the opening 40*c*) of each of the end portions 492*b* continuously increases from the longitudinal end portion side toward the longitudinal central portion side. Even when these constitutions are employed, an effect similar to that of the above-described constitution can be obtained.

Further, in the constitution shown in FIG. 8E, a bonding force of the second welded portion 492 is made large by changing a welding temperature and a welding time at the central portion 492*a* relative to those at the end portions 492*b* without changing the welding width (length with respect to the widthwise direction of the opening 40*c*) thereof. Incidentally, also the welding widths of the third welded portion 493 and the fourth welded portion 494 are 1 mm which is the same as those of the first welded portion 491 and the second welded portion 492. By employing such a constitution, an effect similar to that of Embodiment 1 can be obtained.

OTHER EMBODIMENTS

In the above-described embodiments, as the opening, a constitution in which the single opening 40*c* was provided over the longitudinal direction of the rotatable member 46 was described, but the present invention is not limited thereto. For example, a constitution in which a plurality of openings are arranged in a direction which is the longitudinal direction of the unsealing member may also be employed. In this case, the direction in which the openings are arranged is the longitudinal direction of the openings. Thus, also in the case where the plurality of the openings are disposed, the present invention is effective.

Further, in the above-described embodiments, the developing container constituted as the container by the frame in which the developer is accommodated and which is provided with the opening was described, but the above-described container is not limited thereto. For example, the container may also be constituted by a flexible container accommodating the developer and being provided with the opening and a frame for accommodating the flexible container. In the case of this constitution, the above-described partitioning member is used as a partitioning member for covering the flexible container and for partitioning the developer accommodated in the container. Also by employing such a constitution, similarly as in the above-described embodiments, it is possible to prevent the partitioning member from being peeling off from the container during the unused state and it is possible to minimize a load when the partitioning member is unsealed.

Further, in the above-described embodiments, as the cartridge detachably mountable to the image forming apparatus main assembly, the process cartridge integrally including the photosensitive drum and, as the process means actable on the photosensitive drum, the charging means, the developing means and the cleaning means was described. However, the cartridge detachably mountable to the image forming apparatus main assembly is not limited thereto. The cartridge may also be a process cartridge integrally including, in addition to the photosensitive drum, either one of the charging means, the developing means and the cleaning means. Or, the cartridge may also be a cartridge having a constitution in which the developing device including the above-described developing sleeve is detachably mountable to the apparatus main assembly. Or, the cartridge may also be a cartridge having a constitution in which a developing device including no developing sleeve (i.e., a so-called toner cartridge) is detachably mountable to the apparatus main assembly.

In the above-described embodiments, as the image forming apparatus, the printer was described, but the present invention is not limited thereto. For example, the image forming apparatus may also be other image forming apparatuses such as a copying machine, a facsimile machine and a multi-function machine having functions of these machines. By applying the present invention to the developing devices used in the above-described image forming apparatuses, it is possible to obtain effects similar to those in the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-049193 filed on Mar. 14, 2016, which is hereby incorporated by reference herein in its entirety.

What is claimed is:

1. A developer container comprising:

a container provided with an opening and configured to accommodate a developer;

a sealing member configured to cover the opening; and an unsealing member configured to unseal the opening by moving said sealing member, wherein said sealing member opposes said container at a central opposing portion positioned in a central side and at an end opposing portion positioned at an end side with respect to a longitudinal direction of said unsealing member, wherein said sealing member and said container are bonded to each other at bonding portion which is at least a part of said central opposing portion, and wherein a bonding force at the bonding portion of said central opposing portion is larger than a bonding force between said sealing member and said container at said end opposing portion.

2. A developer container according to claim 1, wherein said end opposing portion with respect to the longitudinal direction is bonded to said container at least a part thereof.

3. A developer container according to claim 1, wherein said end opposing portion with respect to the longitudinal direction is not bonded to said container at least a part thereof.

4. A developer container according to claim 1, wherein said sealing member is bonded to said container over a full circumference of said opening.

5. A developer container according to claim 1, wherein said unsealing member includes a drive transmitting member configured to transmit drive to said unsealing member.

6. A developer container according to claim 5, wherein said unsealing member includes a feeding member configured to feed the developer.

7. A developer container according to claim 1, wherein the bonding portion of said central opposing portion is provided upstream of said opening with respect to a movement direction of said sealing member by said unsealing member.

8. A developer container according to claim 1, wherein said end opposing portion with respect to the longitudinal direction is bonded to said container at least a part thereof, and wherein the bonding portion of said central opposing portion has a width, with respect to a movement direction of said sealing member by said unsealing member, larger than a width of a bonding portion of said end opposing portion with respect to the movement direction.

9. A developer container according to claim 1, wherein the bonding portion of said central opposing portion is provided locally toward one longitudinal end side on the basis of a center line of said opening with respect to the longitudinal direction.

10. A developer container according to claim 1, wherein the bonding portion of said central opposing portion is different in width, with respect to the longitudinal direction, thereof with respect to the movement direction of said sealing member by said unsealing member.

11. A developer container according to claim 1, wherein the bonding portion of said central opposing portion is provided at a plurality of positions between which a non-bonding portion which is not bonded to said container.

12. A developer container according to claim 1, wherein said sealing member is bonded to said container over a full circumference of said opening, and wherein the bonding portion of said central opposing portion increases in width, from an end portion side toward a central portion side with respect to the longitudinal direction, thereof with respect to a movement direction of said sealing member by said unsealing member.

13. A developer container according to claim 1, wherein said container is constituted by a frame in which the developer is accommodated and said opening is provided.

14. A developer container according to claim 1, wherein said container is a flexible container, in which the developer is accommodated and said opening is provided, and wherein said developer container further comprises a frame configured to accommodate said flexible container.

15. A developer container comprising:

a container provided with an opening and configured to accommodate a developer;

a sealing member configured to cover the opening; and an unsealing member configured to unseal the opening by moving said sealing member in a movement direction; and a bonding portion formed between said sealing member and said container along a longitudinal direction of said opening, wherein a width, with respect to the movement direction, of said bonding portion at a central portion with respect to the longitudinal direction is larger than a width, with respect to the movement direction, of said bonding portion at an end portion with respect to the longitudinal direction.

16. A developer container according to claim 15, wherein said sealing member is bonded to said container over a full circumference of said opening.

17. A developer container according to claim 15, wherein said unsealing member includes a drive transmitting member configured to transmit drive to said unsealing member.

18. A developer container according to claim 17, wherein said unsealing member includes a feeding member configured to feed the developer.

19. A developer container according to claim 15, wherein said bonding portion is provided locally toward one longitudinal end side on the basis of a center line of said opening with respect to the longitudinal direction.

20. A developer container according to claim 15, wherein said bonding portion is provided at a plurality of positions between which a non-bonding portion which is not bonded to said container.

21. A developer container according to claim 15, wherein said sealing member is bonded to said container over a full circumference of said opening, and wherein said bonding portion increases in width, from an end portion side toward a central portion side with respect to the longitudinal direction, thereof with respect to a movement direction of said sealing member by said unsealing member.

22. A cartridge detachably mountable to an image forming apparatus, comprising:

a developer carrying member configured to feed a developer to an image bearing member; and a developer container comprising a container provided with an opening and configured to accommodate a developer;

a sealing member configured to cover the opening; and an unsealing member configured to unseal the opening by moving said sealing member, wherein said sealing member opposes said container at a central opposing portion positioned in a central side and at an end opposing portion positioned at an end side with respect to a longitudinal direction of said unsealing member, wherein said sealing member and said container are bonded to each other at bonding portion which is at least a part of said central opposing portion, and wherein a bonding force at the bonding portion of said central opposing portion is larger than a bonding force between said sealing member and said container at said end opposing portion.

23. An image forming apparatus configured to form an image on a recording material, comprising:

an image bearing member;

a developer carrying member configured to supply a developer to said image bearing member; and a developer container comprising a container provided with an opening and configured to accommodate a developer;

a sealing member configured to cover the opening; and an unsealing member configured to unseal the opening by moving said sealing member, wherein said sealing member opposes said container at a central opposing portion positioned in a central side and at an end opposing portion positioned at an end side with respect to a longitudinal direction of said unsealing member, wherein said sealing member and said container are bonded to each other at bonding portion which is at least a part of said central opposing portion, and wherein a bonding force at the bonding portion of said central opposing portion is larger than a bonding force between said sealing member and said container at said end opposing portion.

* * * * *